US006394778B1

(12) United States Patent
Blasingame

(10) Patent No.: US 6,394,778 B1
(45) Date of Patent: May 28, 2002

(54) VANE RESTRAINT MECHANISM FOR AXIAL-VANE ROTARY DEVICE

(76) Inventor: Thomas W Blasingame, P.O. Box 1532, Boise, ID (US) 83701

( * ) Notice: Subject to any disclaimer, the term of this patent is extended or adjusted under 35 U.S.C. 154(b) by 0 days.

(21) Appl. No.: 09/582,129

(22) PCT Filed: Dec. 22, 1998

(86) PCT No.: PCT/US98/27511

§ 371 (c)(1),
(2), (4) Date: Nov. 2, 2000

(87) PCT Pub. No.: WO99/34095

PCT Pub. Date: Jul. 8, 1999

(51) Int. Cl.[7] ..... F01C 1/344
(52) U.S. Cl. ..... 418/219; 418/231; 418/252
(58) Field of Search ..... 418/217, 219, 418/228–232, 235, 252

(56) References Cited

U.S. PATENT DOCUMENTS

| | | | | | |
|---|---|---|---|---|---|
| 570,584 | A | * | 11/1896 | White | 418/231 |
| 2,688,385 | A | * | 9/1954 | McLaughlin et al. | 418/219 |
| 3,204,567 | A | * | 9/1965 | Krawacki | 418/231 |
| 4,004,556 | A | * | 1/1977 | Pfeiffer | 418/219 |

* cited by examiner

*Primary Examiner*—John J. Vrablik
(74) *Attorney, Agent, or Firm*—Zarley McKee Thomte Voorhees & Sease

(57) ABSTRACT

An axial-vane rotary device with a rotor assembly having a rotor core and a plurality of removable end blocks attached to the core, end blocks having recesses to encapsulate a vane restraint mechanism, and a removable end wall on one or more of the end blocks.

17 Claims, 16 Drawing Sheets

VANE RESTRAINT MECHANISM FOR AXIAL-VANE ROTARY DEVICE

BACKGROUND OF THE INVENTION

A typical axial vane rotary device of the prior art (e.g. U.S. Pat. No. 5,429,084) includes a stator with a cylindrical internal chamber having an annular outer wall and end side walls. Each end wall has an annular cam surface. A rotor is rotatably mounted within the chamber. The rotor has an annular outer wall and a plurality of singularly spaced apart, axially extending slots extending therethrough. A vane is slidably received in each slot. The vanes reciprocate axially and alternatively expand and compress spaces between adjacent vanes and the cam surfaces as the rotor rotates. The cam surfaces have alternating first portions and second portions. The second portions are further from the rotor than the first portions. The first portions of one cam surface are aligned with second portions of another cam surface at the opposite end of the device. The slots extend radially outwards on the rotor to the outer wall thereof. The outer end of each vane slidably engages the annular outer wall of the stator. The outer wall of the stator may have a guide cam and the vanes may have a follower received by the guide cam. The guide cam is shaped to cause the vanes to reciprocate axially with respect to the rotor as the rotor rotates. Each of the vanes may have resiliently biased first seals extending along the inner edge and second seals along end edges thereof In the above prior art device, the vanes, during rotation of the rotor, move outwardly due to centrifugal force and ride on a film of oil or water on the surface of the annular outer wall. This action is adequate on small axial vane rotary devices or in axial vane rotary devices operating at low speeds, but it is not adequate in large axial vane rotary devices or in axial vane rotary devices operating at high speeds. In such large or high speed axial vane rotary devices, the centrifugal forces build up to such a degree that the annular outer wall cannot withstand these forces and the action of the vanes on the annular outer wall causes excessive wear or damage to these components.

Therefore, a primary objective of the present invention is to provide a means of restraining the vanes from moving outwardly during rotation.

A further objective of the present invention is to provide this restraining action for the vanes in a manner that is independent of the action of the prior art axial vane rotary device.

A still further objective of the present invention is to provide this restraining action on the vanes in a manner that is completely automatic and which does not require any direct control mechanism.

A still further objective of the present invention is to provide this restraining action for the vanes in a manner that will not adversely affect the efficiency or operation of the prior art axial vane rotary device.

A still further objective of the present invention is to provide this restraining action for the vanes in a manner that will not adversely affect the safety or reliability of the prior art axial vane rotary device.

A still further objective of the present invention is to provide this restraining action for the vanes in a manner that will permit economical manufacture and installation in the prior art axial vane rotary device.

These and other objectives will be apparent to those skilled in the art.

SUMMARY OF THE INVENTION

The present invention of a vane restraint mechanism for an axial vane rotary mechanism includes a rotor core block which is drilled and tapped to permit the installation of a number of removable rotor end block assemblies. Each of these removable end block assemblies has side portions which are configured to provide a transverse surface parallel to the rotor transverse centerline. Each of the prior art transversely slidable vanes is modified to permit the installation of one or more fixed slide blocks, rotatable rollers, or pivotably mounted rocker assemblies. Each fixed slide block, roller, or rocker assembly bears against the interior surface of these rotor end block assemblies and prevents the rotor from moving outwardly due to centrifugal force.

The fixed mounting of the slide blocks or the rotatable structure of the rollers or rockers of the present invention permit the vanes to operate in the manner similar to the prior art, but prevents any excessive outward travel of the vane that could be caused by centrifugal force.

The attachment of the fixed slide bearing blocks or the rollers or rockers to the vane may be accomplished by any convenient means, but the preferred method is with stainless steel or equivalent pins with stainless steel snap rings.

The use of a rotor core block with a number of individually removable rotor end blocks permits the vane restraint mechanism on each vane to be enclosed completely and allows the seals of the prior art axial vane rotary device to be applied as originally designed at the ends of the vanes and at the surfaces of the annular outer ring. When the vane restraint mechanism is of the two-tier configuration, the removable rotor end blocks are equipped with a removable end panel on two of the rotor end blocks. These removable end panels permit the vane and its attached vane restraint mechanism components to be removed or installed after or while the rotor end blocks are in place on the rotor core block. The removable side panel of the rotor end blocks is not necessary on one-tier vane restraints such as the rockers.

Access for installation or removal of the vanes and vane restraint mechanisms is made possible by means of a removable cover on the annular outer wall and end portions of the casing.

BRIEF DESCRIPTION OF THE DRAWINGS

FIG. 1B-1 is a sectional elevational view taken on lines 1B-1 of FIG. 1B;

FIG. 1B-2 is an elevational view taken on line 1B-2 of FIG. 1B-1;

FIG. 2B-1 is a sectional elevational view taken on lines 2B-1 of Fig 2B;

FIG. 2B-2 is an elevational view taken on line 2B-2 of FIG. 2B-1;

FIG. 3B-1 is a sectional elevational view taken on lines 3B-1 of FIG. 3B; and

FIG. 3B-2 is an elevational view taken on line 3B-2 of FIG. 3B-1;

FIG. 4B-1 is a sectional elevational view taken on lines 4B-1 of FIG. 4B; and

FIG. 4B-2 is an elevational view taken on line 4B-2 of FIG. 4B-1;

DESCRIPTION OF THE PREFERRED EMBODIMENT

Figure 1A:
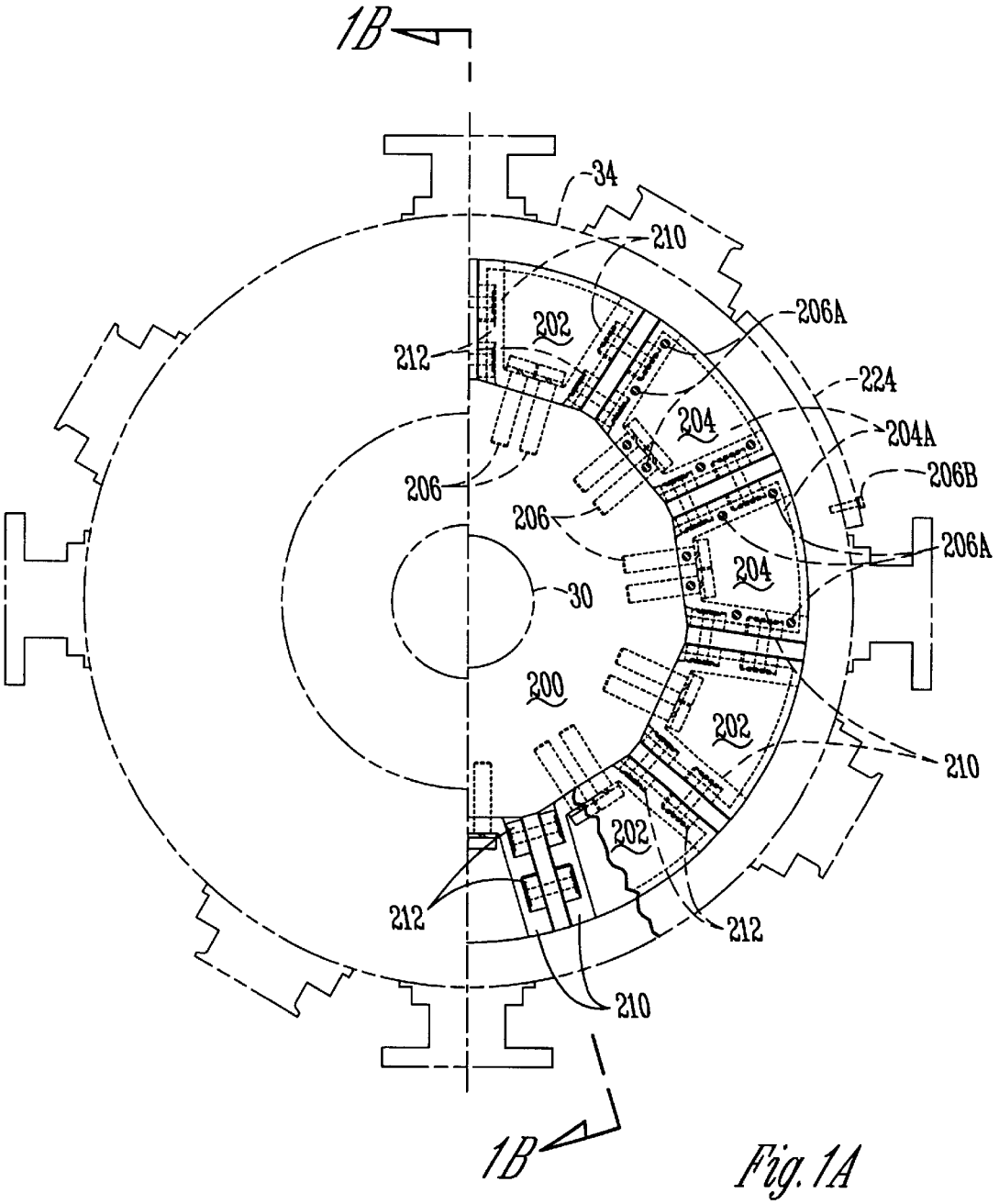
FIG. 1A is a half front view and a half section of an axial-vane rotary device of the present invention.
Figures 1, 1B, 2:
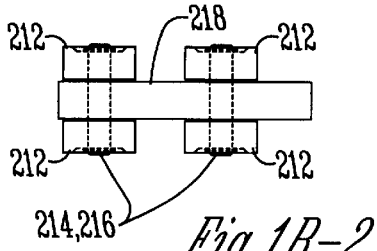
Figures 1, 1B:
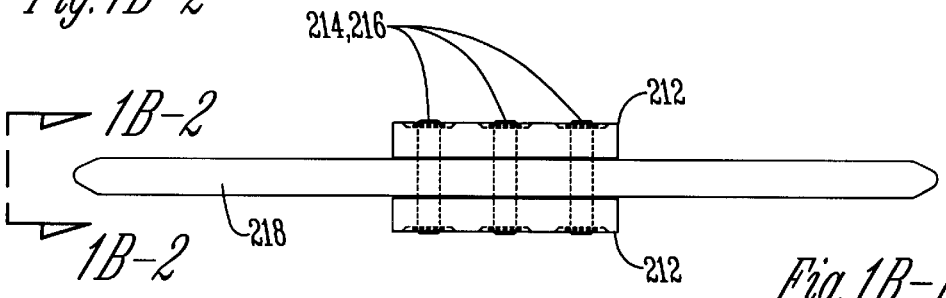
Figure 1B:
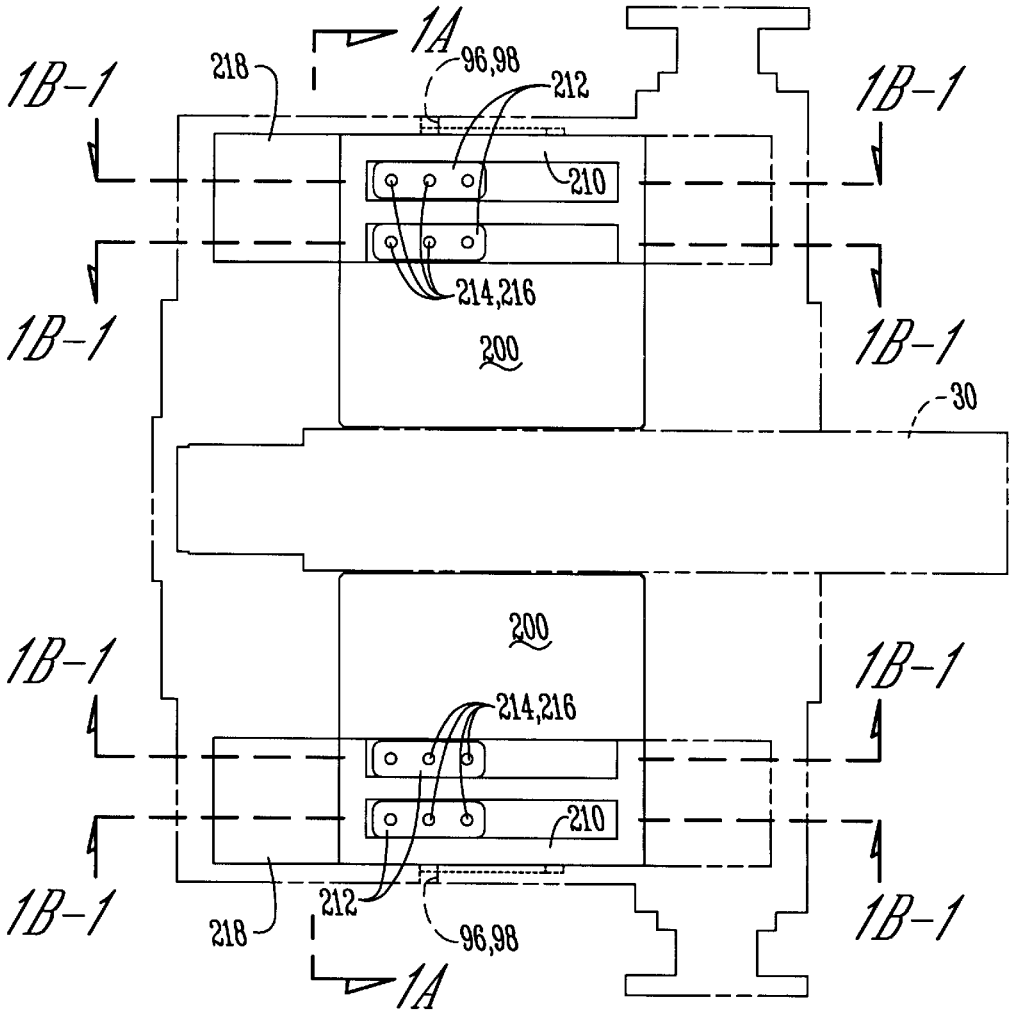
FIG. 1B is a sectional elevation of an axial-vane rotary device of the present invention taken on line 1B—1B of FIG. 1A.

FIG. 1A is a half front view and a half sectional view cut generally along on line 1A—1A in FIG. 1B. This half sectional view shows a rotor core 200 and segmental individual rotor end blocks 202 which are attached to rotor core 200 by means of fasteners 206. Two of the segmental individual rotor end blocks 204 have removable end plate 204*a*. In the assembly of the axial-vane rotary device of the present invention, the drive shaft 30 with rotor core 200 is installed in the cylindrical internal chamber 34. Vane and rotor access cover 224 is not secured to the cylindrical internal chamber 34 as it is required to be removed for access. Through the opening in the cylindrical internal chamber 34 made possible by vane and rotor access cover 224, a segmental individual rotor end block 202 is secured to the rotor core 200 by a plurality of fasteners 206 and properly torqued. Then a vane assembly comprised of vane 218 and four each slide blocks 212 secured to the vane by pins 214 and stainless steel snap rings 216 is set in place on the rotor block 200 adjacent to the previously installed segmental individual rotor end block 202.

Another segmental individual rotor end block 202 is installed through the rotor access opening by means of fasteners 206 and properly torqued. The remaining vane assemblies and segmental individual rotor end blocks are installed in this manner until only two vanes and segmental individual rotor end blocks remain to be installed. At this time, one of the segmental individual rotor end blocks 204 is installed without its removable end plate 204*a*. The vane assembly for the position adjacent this segmental individual rotor end block 204 is not installed. The last segmental individual rotor end block 204, without its end plate 204*a*, is installed with a vane assembly next to the first segmental rotor end block 202 installed. At this time the rotor is revolved until the space between the two segmental individual rotor end blocks 204 is correctly aligned with the rotor access opening. The last vane assembly 218, with its attached slide blocks 212 is inserted through the end portion of the vane rotor access opening into the space between the two segmental individual rotor end blocks 204. The two segmental individual rotor end block end plates 204*a* are attached with threaded fasteners 206*a*. The vane and access cover 224 is then secured to the cylindrical internal chamber 34 by means of threaded fasteners 206*b*. To disassemble the axial-vane rotary device of the present invention, this process is reversed.

FIG. 1B is a sectional view showing the vanes 218 and their slide blocks 212 in the extreme left-hand position. The center of the vane 218 and the slide blocks 212 are at the location of the guide cam 96 and follower 98.

Figure 1C:
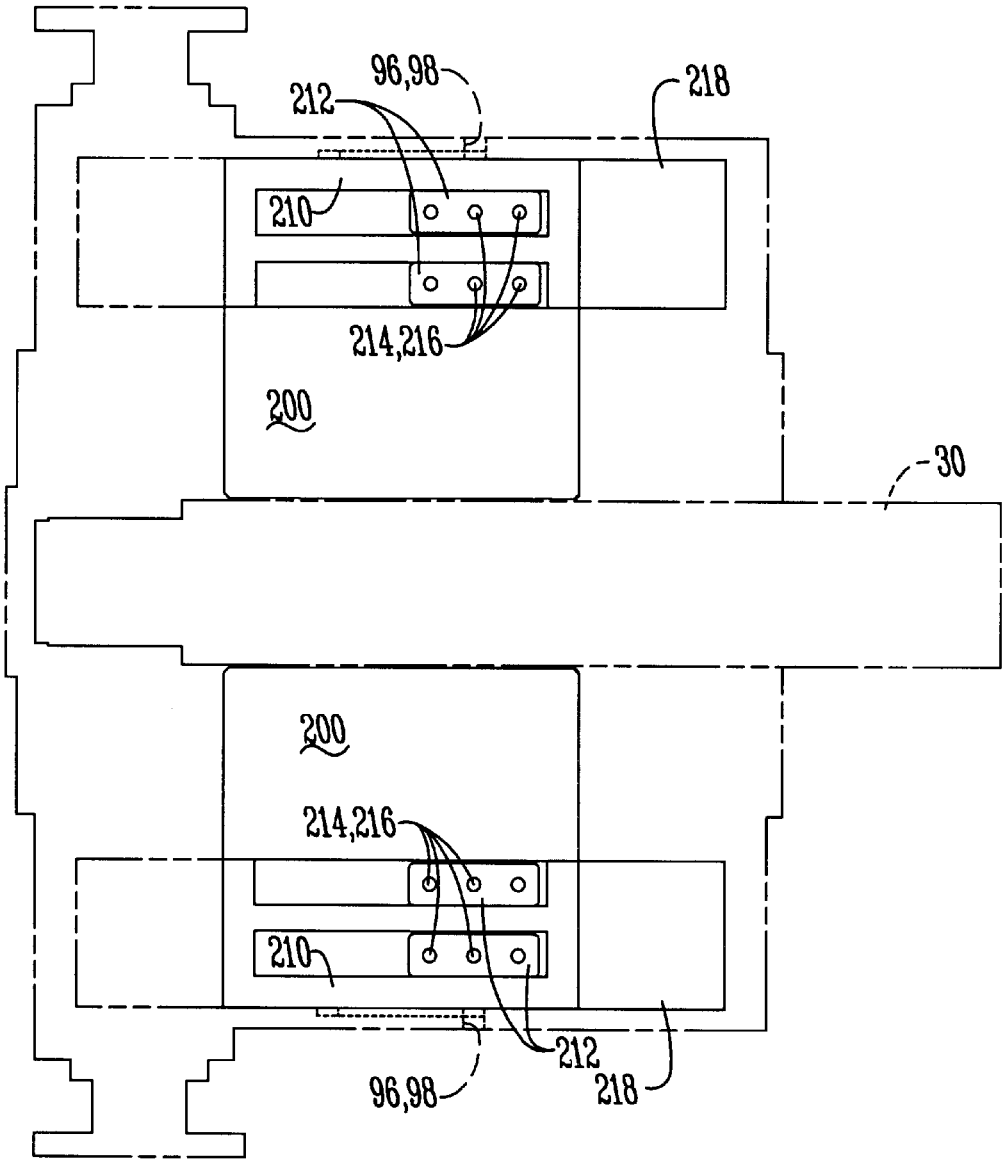
FIG. 1C is a sectional view taken at 90 degrees with respect to FIG. 1B.

FIG. 1C is a sectional view taken at 90 degrees rotation from the view shown in FIG. 1B. This view shows the vanes 218 extended to the extreme right hand position and the slide blocks 212 have also shifted to the extreme right hand position within the cavities in the segmental individual rotor end blocks 202 or 204. Again, the centerlines of the vanes and the slide blocks are in line with the centerlines of the guide cam 96 and follower 98.

Figure 1D:
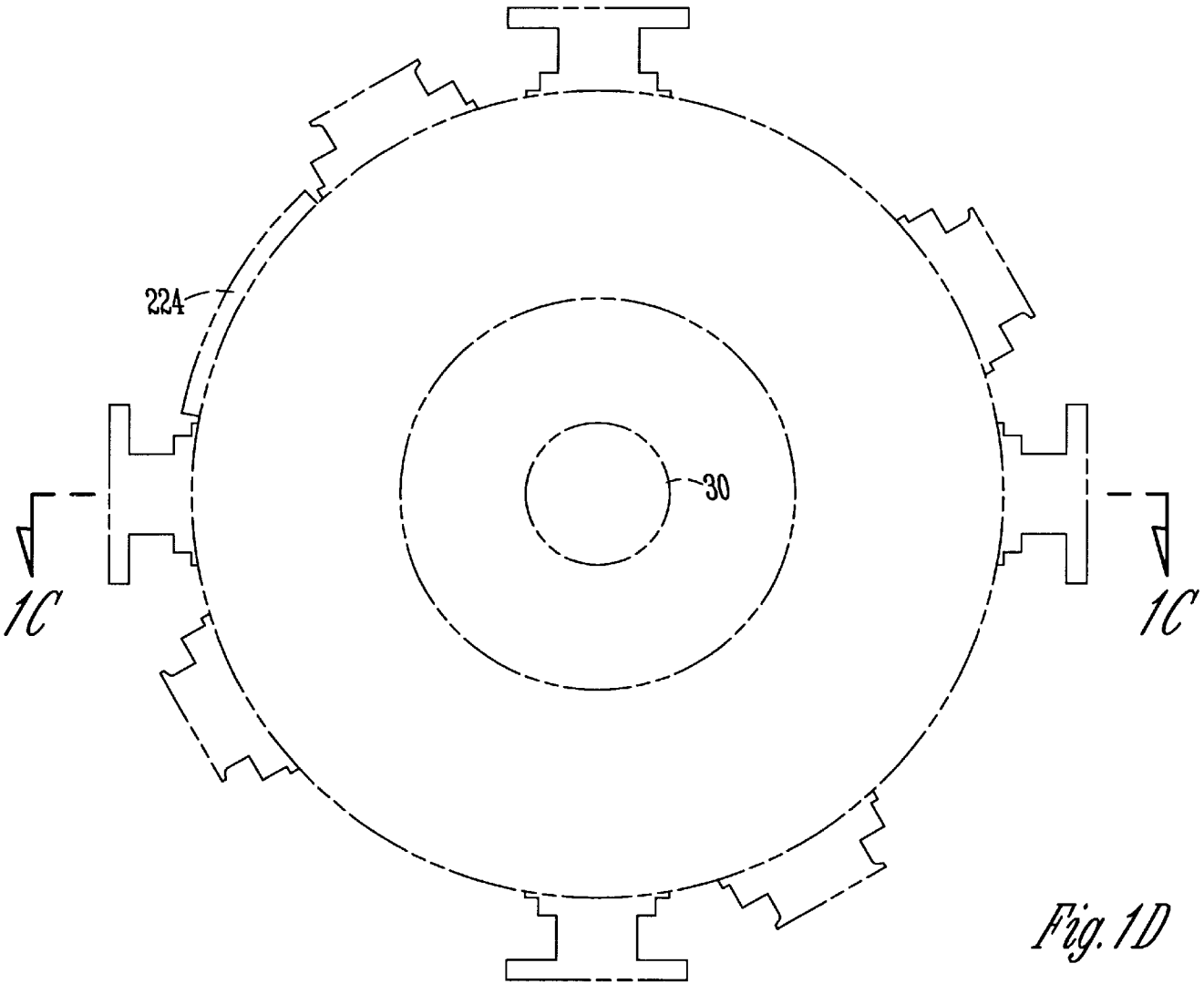
FIG. 1D is an elevational view of an axial-vane rotary device showing the end of the drive shaft.

FIG. 1D is an elevational view of the drive end of the present invention of an axial-vane rotary device.

It is to be noted that the reason the segmental individual rotor end blocks 204 have removable end plates 204i ais that the two-tier ledge configuration of the rotor end blocks prevents these parts from being removed outwardly when a vane 218 with its restraint devices (slide blocks 212) is in place. Therefore, the last two segmental individual rotor end blocks must have provision for installing the vane assembly between them from the side of the rotor 200, through the vane and rotor access opening. The vane restraint ledges 210 are shown in FIGS. 1A, 2A and 1C.

It is also to be noted that the slide blocks 212 may be made integral with vanes 218 without departing from the spirit of the invention.

Figure 2A:
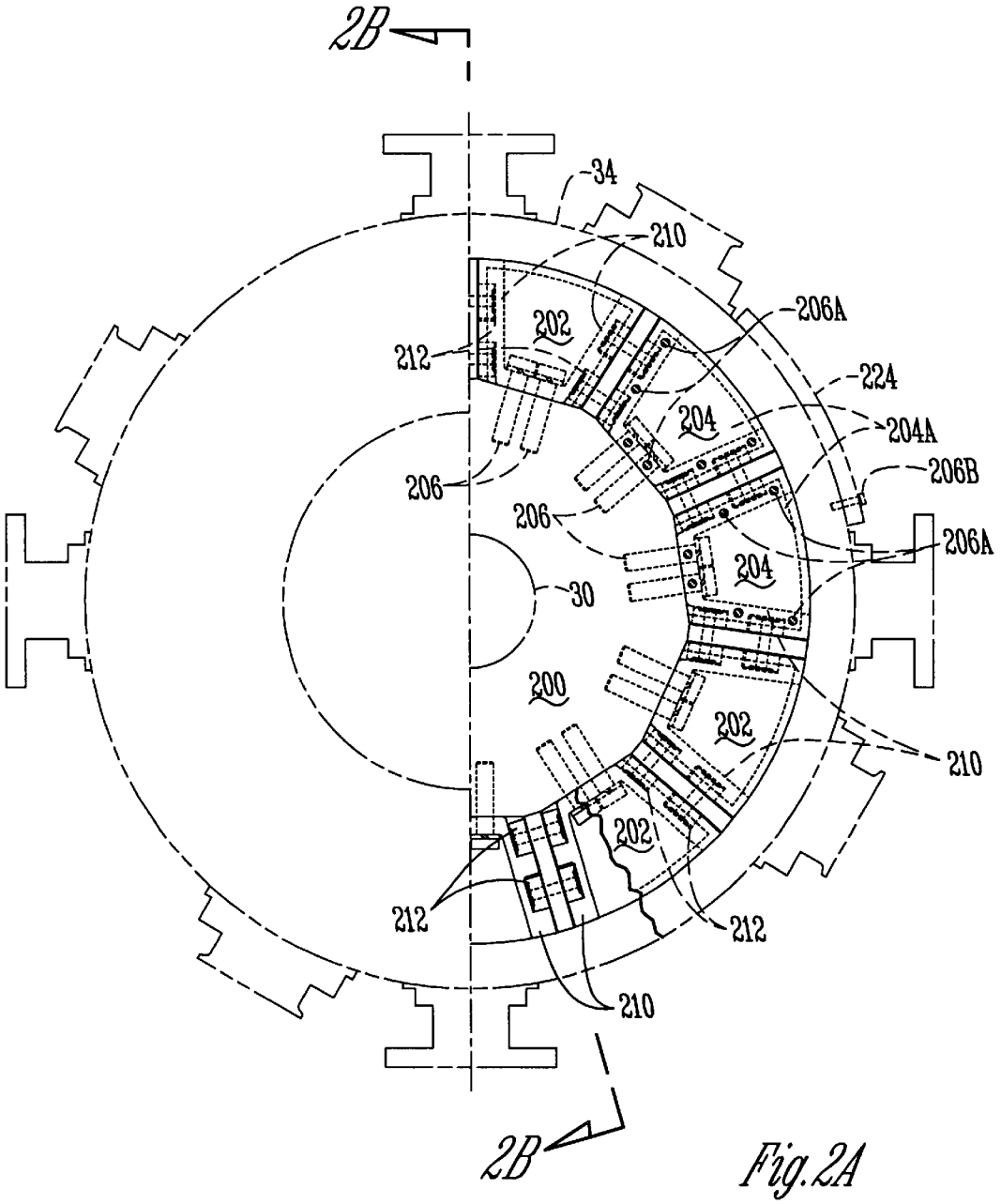
FIG. 2A is a half front view and a half section of an axial-vane rotary device of the present invention.
Figures 2, 2B:
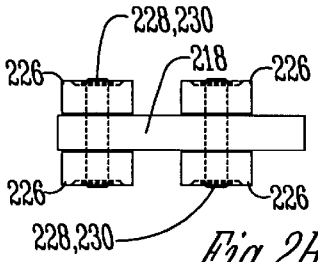
Figures 1, 2B:
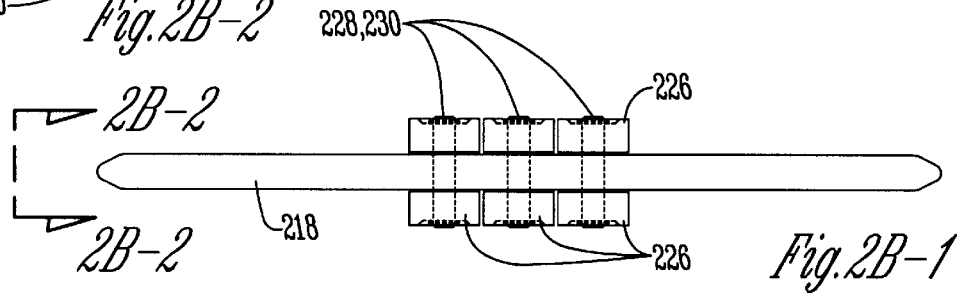
Figure 2B:
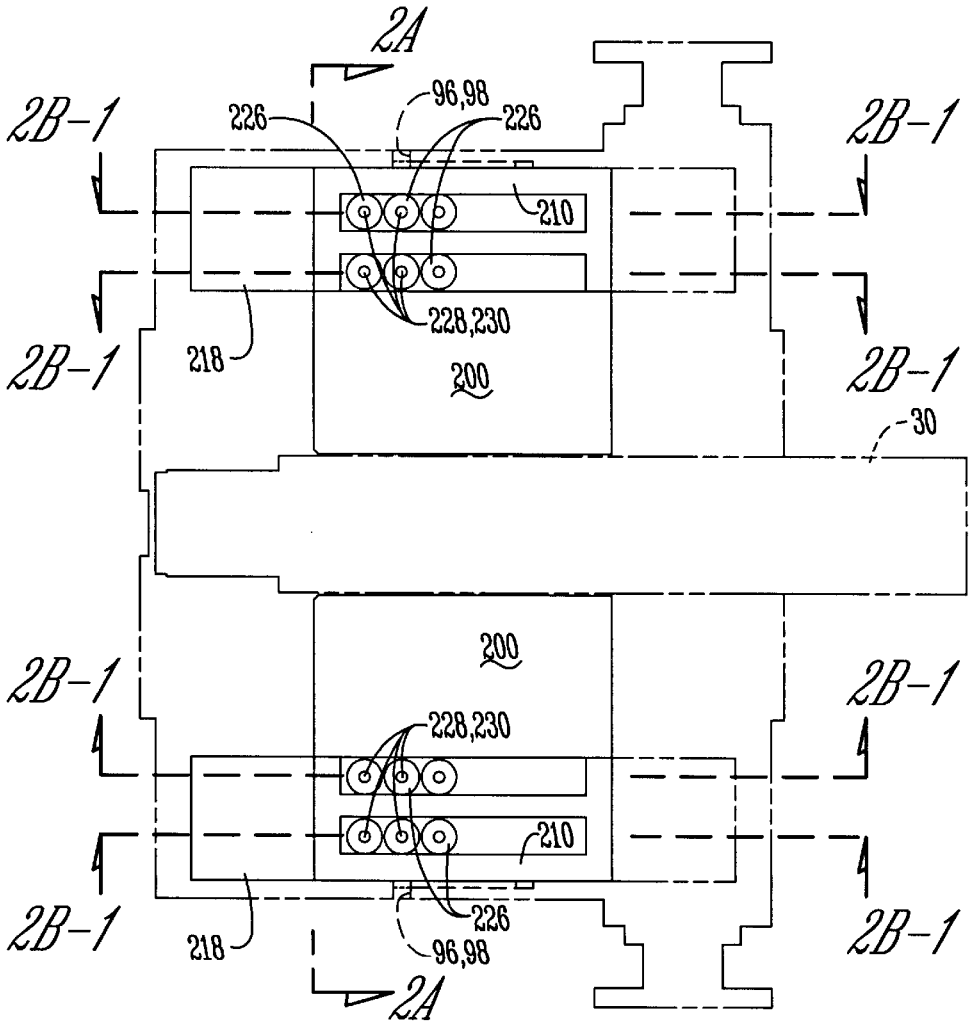
FIG. 2B is a sectional elevation of an axial-vane rotary device of the present invention taken on line 2B—2B of FIG. 2A.

FIG. 2A is a half front view and a half sectional view similar to that of FIG. 1*a*. The rotor parts shown are identical to those shown in FIG. 1A. The only difference is that the vanes 218 are fitted with individual rollers (as shown in FIG. 2B) 226 on each side of the vane, rotatably mounted on axles 228 and secured by means of stainless steel snap rings 230. Assembly or disassembly of the vane assemblies 218 and segmental individual rotor end blocks 202 and 204 are as previously outlined for the adaptation with slide blocks.

FIG. 2B is a sectional elevation showing the vanes 218 and their rollers 226 in the extreme left-hand position. The center of the vanes 218 and the group of a plurality of rollers is centered at the location of the guide cam 96 and follower 98.

Figure 2C:
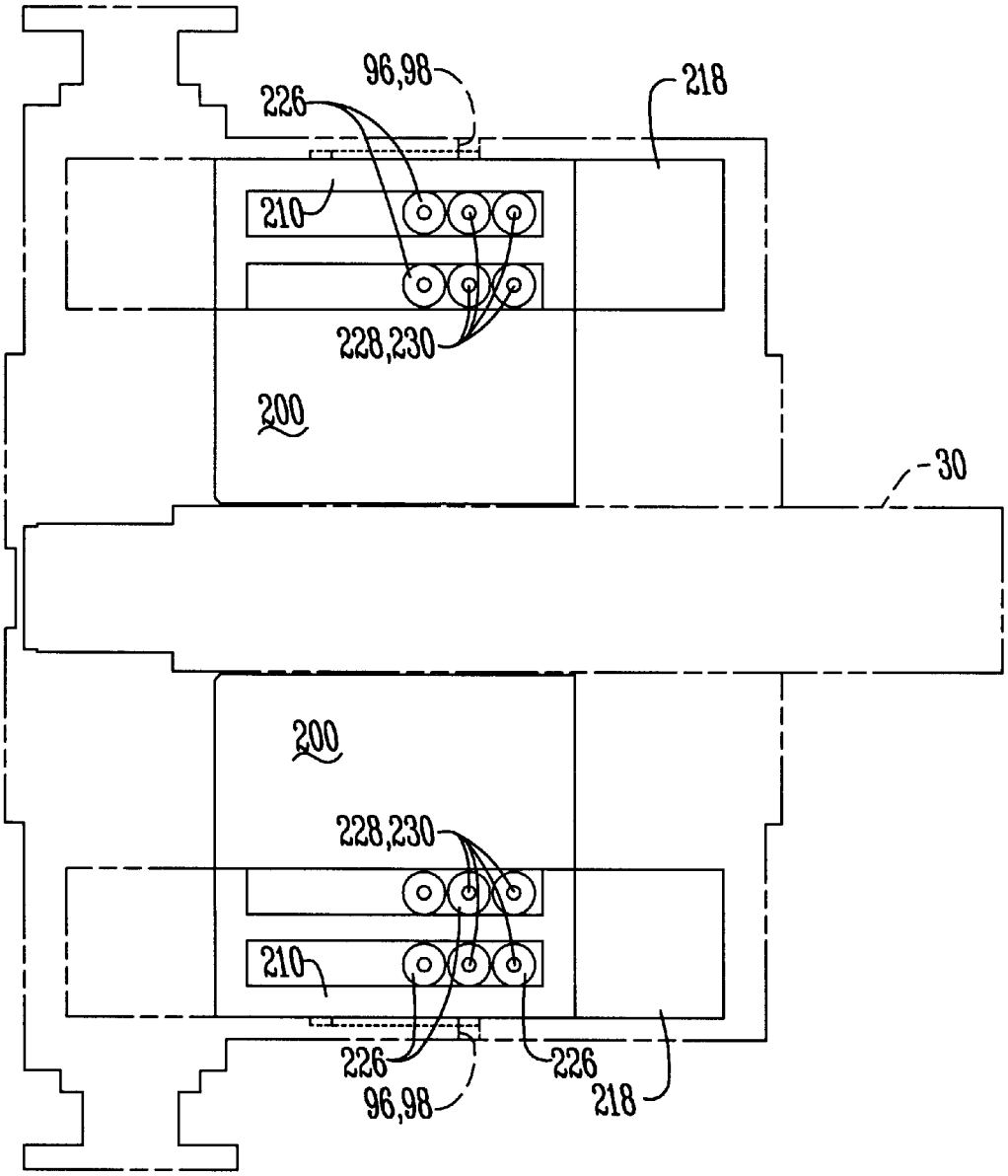
FIG. 2C is a sectional view taken at 90 degrees with respect to FIG. 2B.

FIG. 2C is a sectional view taken at 90 degrees rotation from the view shown in FIG. 2B. This view shows the vanes 218 extended to the extreme right-hand position and the rollers 226 have also shifted to the extreme right-hand position within the cavities in the segmental individual rotor end blocks 202 or 204. Again, the centerlines of the vanes and the roller 226 group remain oriented with the centerlines of the guide cam 96 and follower 98.

Figure 2D:
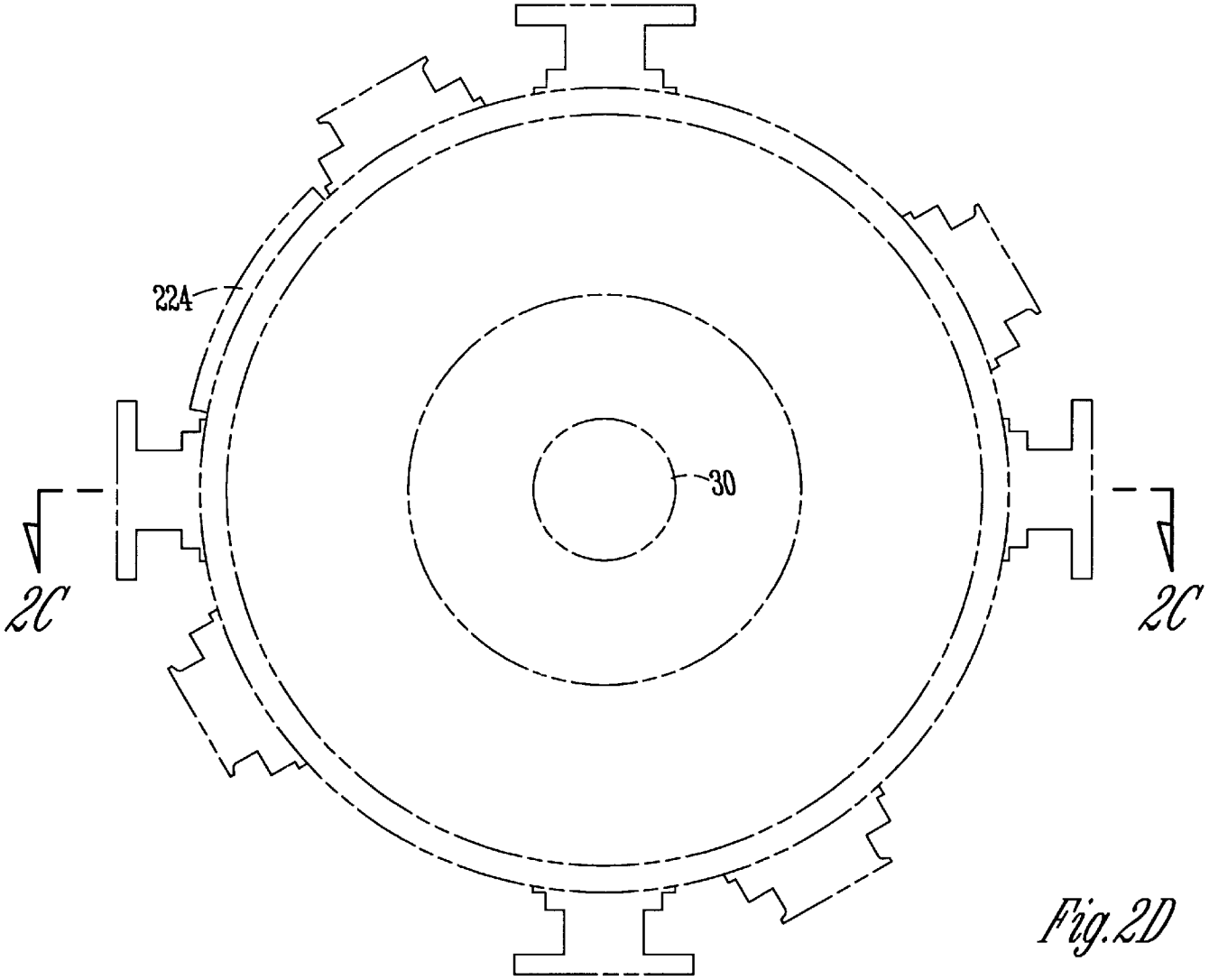
FIG. 2D is an elevational view of an axial-vane rotary device showing the end of the drive shaft.

FIG. 2D is an elevation view of the drive end of the present invention of an axial-vane rotary device.

Figure 3A:
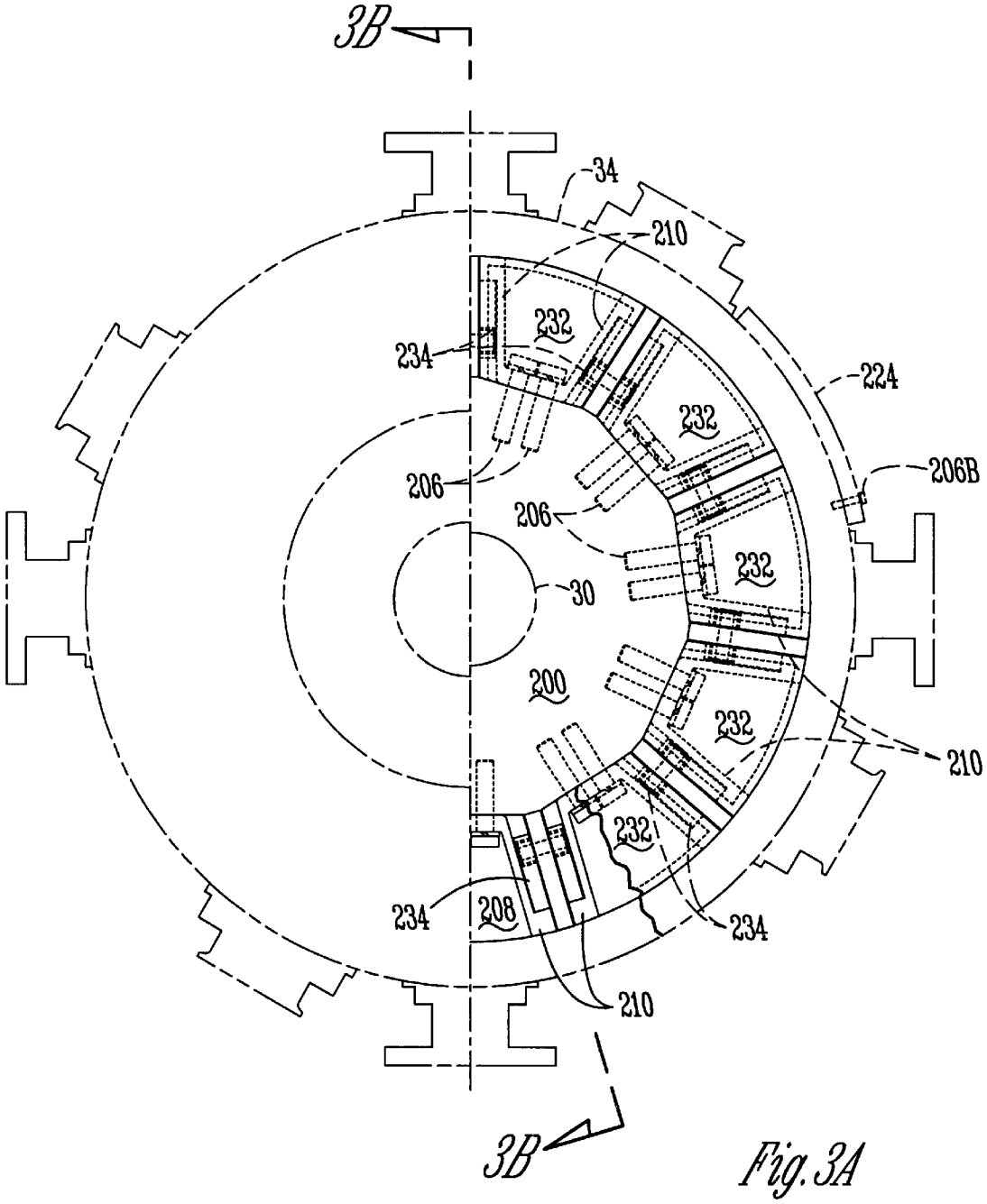
FIG. 3A is a half front view and a half section of an axial-vane rotary device of the present invention.
Figures 2, 3B:
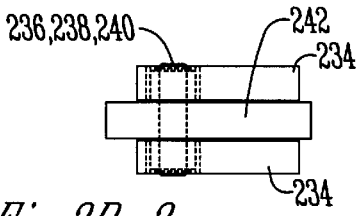
Figures 1, 3B:
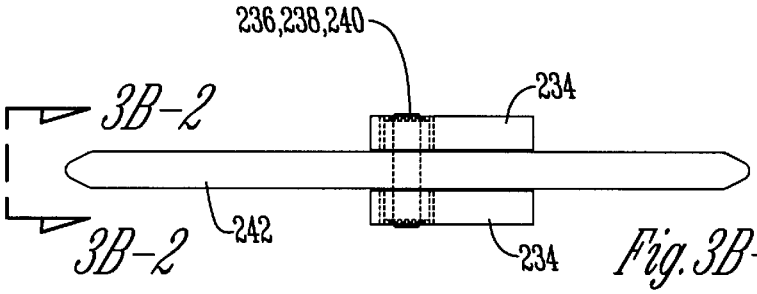
Figure 3B:
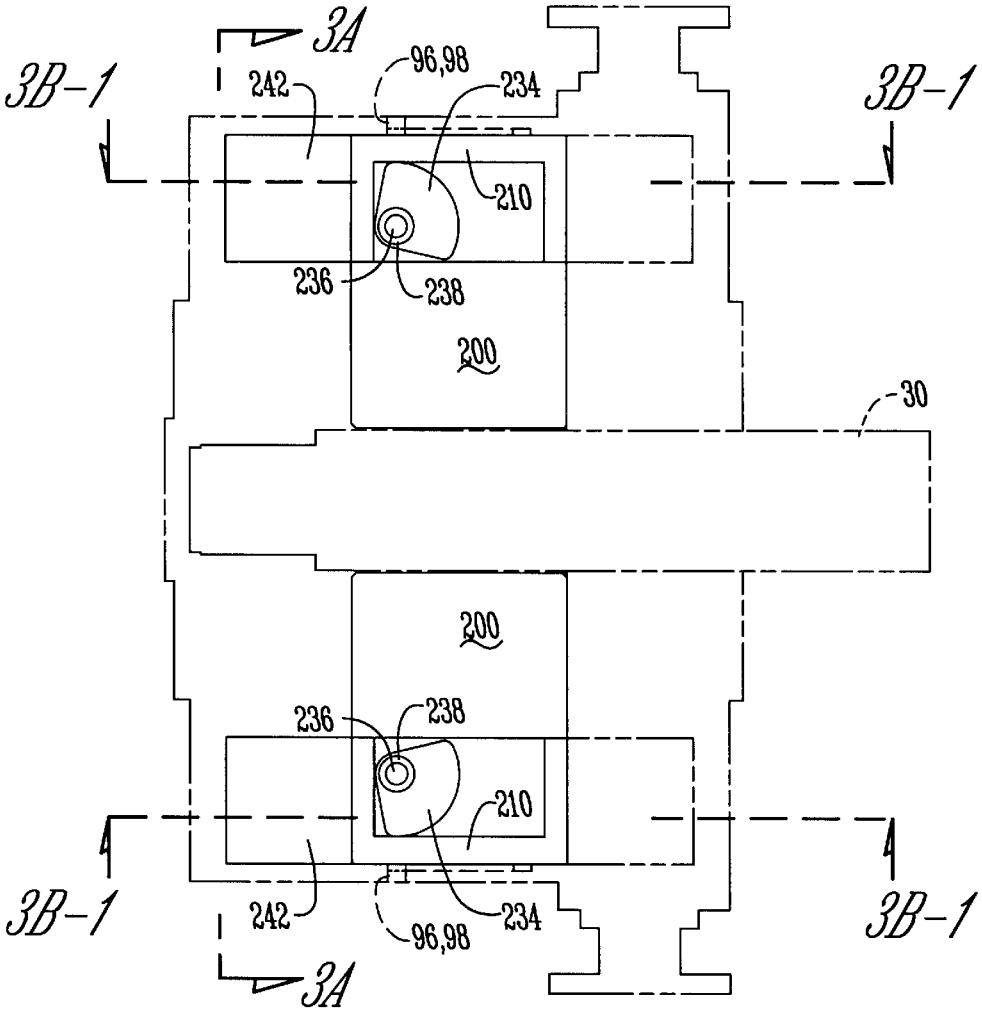
FIG. 3B is a sectional elevation of an axial-vane rotary device of the present invention taken on line 3B—3B of FIG. 3A.

FIG. 3A is a half front view and a half sectional view cut generally along view line 3A—3A in FIG. 3B. The rotor core 200 is equipped with a plurality of segmental individual rotor end blocks 232, each with a one-tier retainer ledge 210 at the outer extremities adjacent to the vane assemblies 242. Because there is no second retainer ledge midway inside the side cavities, these segmental individual rotor end blocks may be installed or removed from the rotor core 200 radially through the vane and rotor access opening under vane and rotor access cover 224. In this design there is no need for removable end plates as were required in the versions with slide blocks 212 or rollers 226, shown in FIGS. 3B and 4B respectively.

FIG. 3B is a sectional view showing the vanes 242 and rockers 234 mounted on axles 236 with bearings 238 and secured by stainless steel snap rings 240, all moved to the extreme left-hand position. Rockers 234 are designed to have a rolling surface corresponding to the stroke length of the vanes. The centerline of the rocker axle 236 coincides with the location of the vane 242 vertical centerline and the location of the guide cam 96 and follower 98, when the vane assembly 242 is in the extreme left-hand position. When the vane assembly 242 moves to the extreme right-hand position, the centerline of the rocker axle 236 follows and stays aligned with the guide cam 96 and follower 98. The rocker 234 bears on the retainer ledge 210 shown in FIG. 3A and is always in compression. The relatively large radius of the rockers 234 compared to the shorter, radius of the rollers 226 shown in FIG. 2B reduces the amount of rotation required to achieve the necessary motion required by the stroke of the axial-vane rotary device.

Figure 3C:
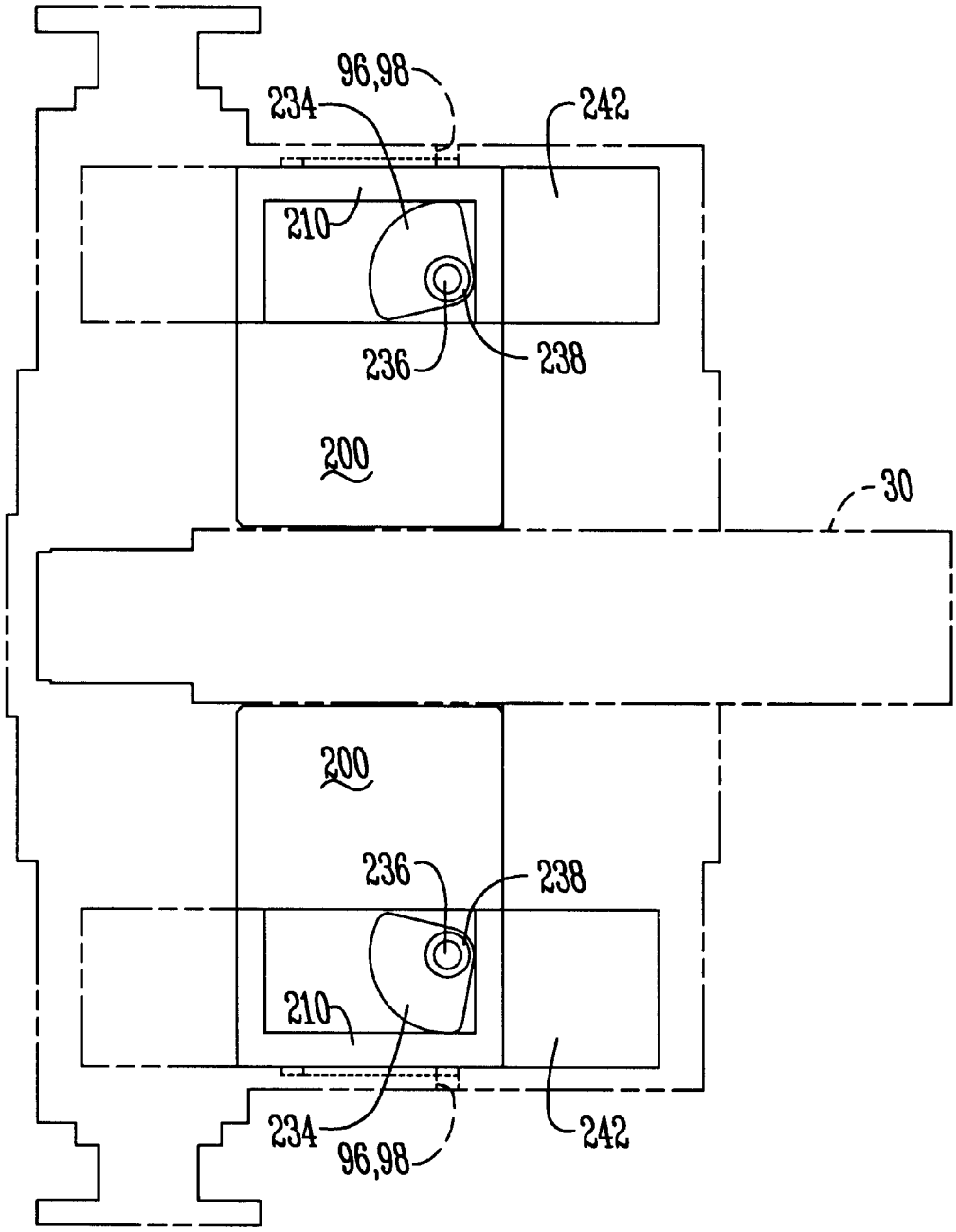
FIG. 3C is a sectional view taken at 90 degrees with respect to FIG. 3B.

FIG. 3C is a sectional view taken at 90 degrees from the view shown in FIG. 3B, and shows the vanes assemblies 242 moved to their extreme right-hand position. Rockers 234 have also moved to the extreme right-hand position in the cavities on each side of segmental individual rotor end blocks 232, and the centerline of rocker axle 236 again coincides with the location of the vane 242 vertical centerline and the location of the guide cam 96 and follower 98.

Figure 3D:
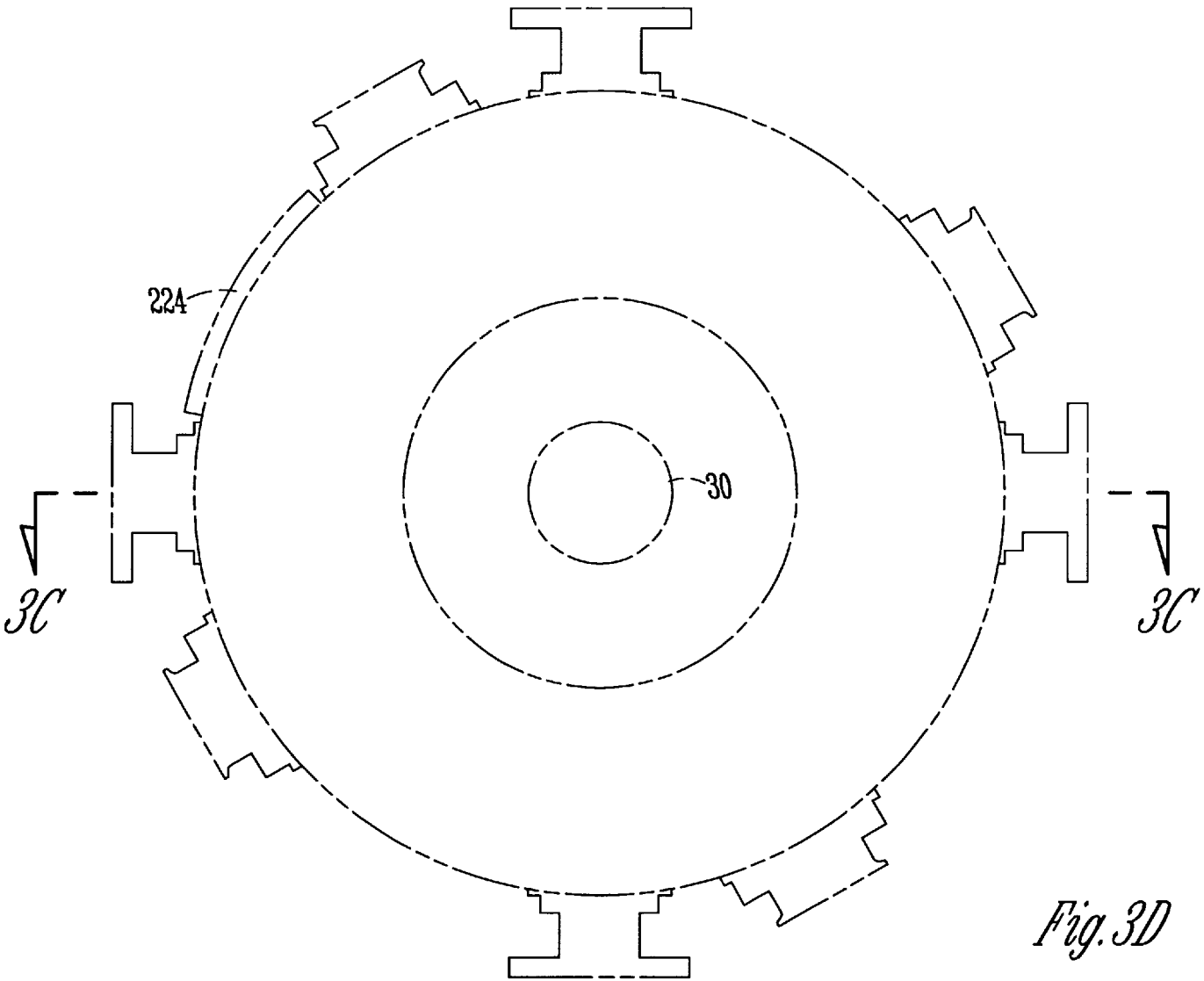
FIG. 3D is an elevational view of an axial-vane rotary device showing the end of the drive shaft.

FIG. 3D is an elevation view of the drive end of the present invention of an axial-vane rotary device.

Figure 4A:
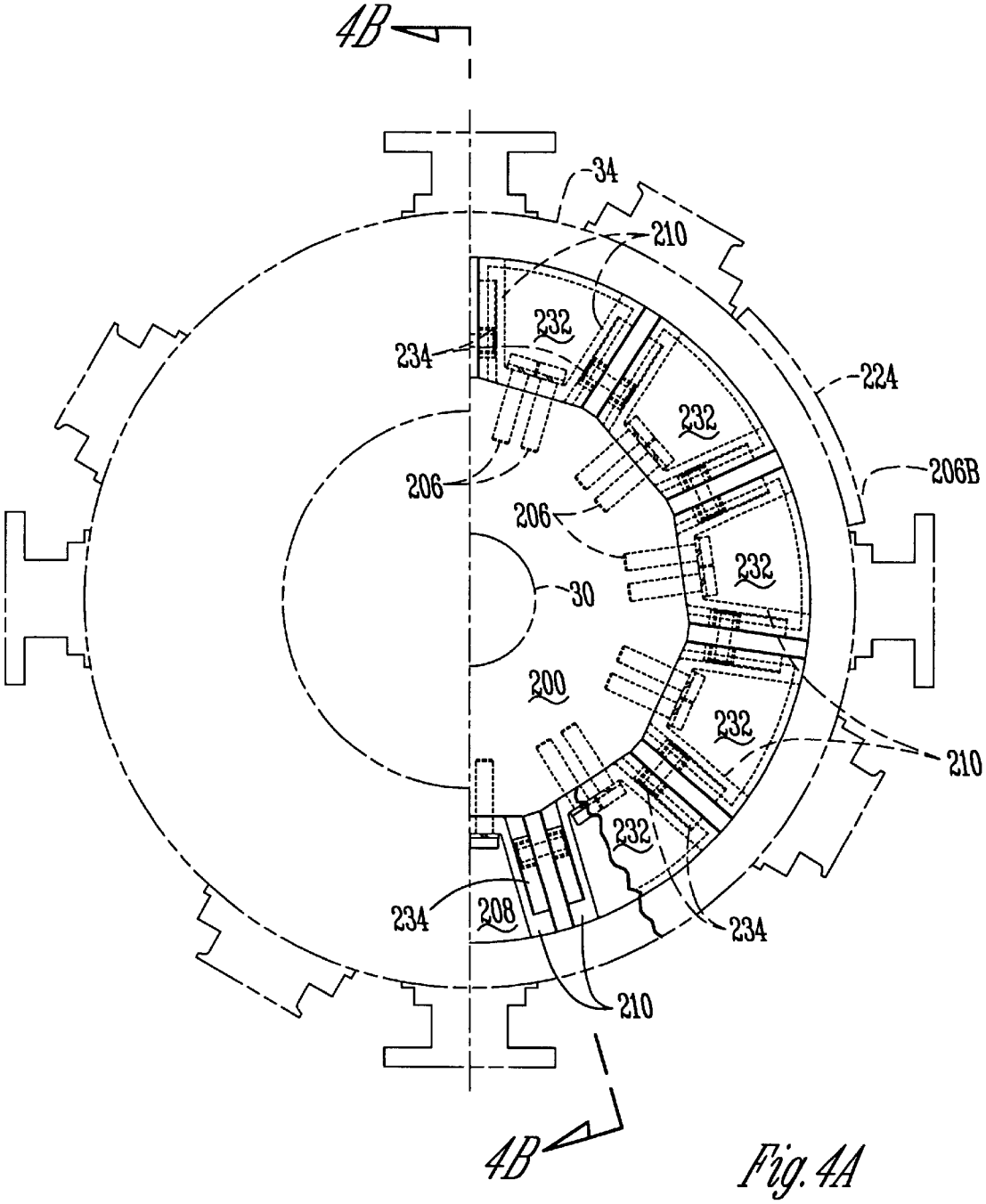
FIG. 4A is a half front view and a half section of an axial-vane rotary device of the present invention.

FIG. 4A is a half front view and a half sectional view similar to FIG. 1A. The rotor core 200 is equipped with a plurality of segmental individual rotor end blocks 232, each with a one-tier retainer ledge 210 at the outer extremities adjacent to the vane assemblies 244. Because there is no second retainer ledge midway inside the side cavities, these segmental individual rotor end blocks may be installed or removed from the rotor core 200 radially through the vane and rotor access opening under vane and rotor access cover 224. In this design there is no need for removable end plates as were required in the versions with slide blocks 212 or rollers 226, shown in FIGS. 1A and 2B respectively.

Figures 2, 4B:
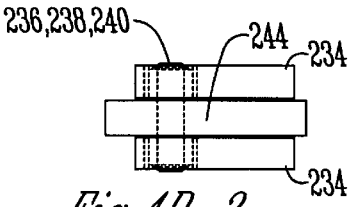
Figures 1, 4B:
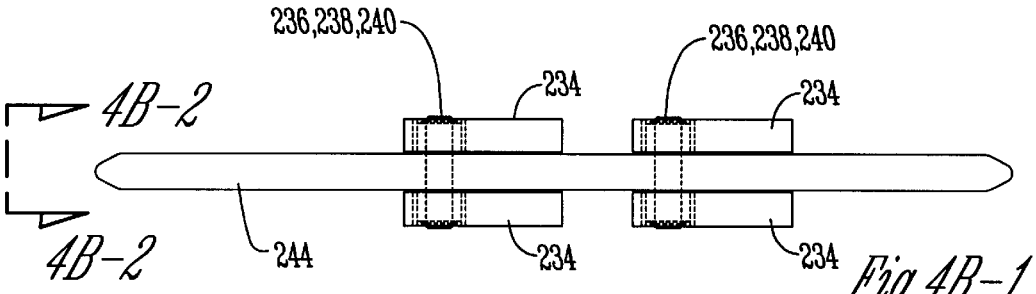
Figure 4B:
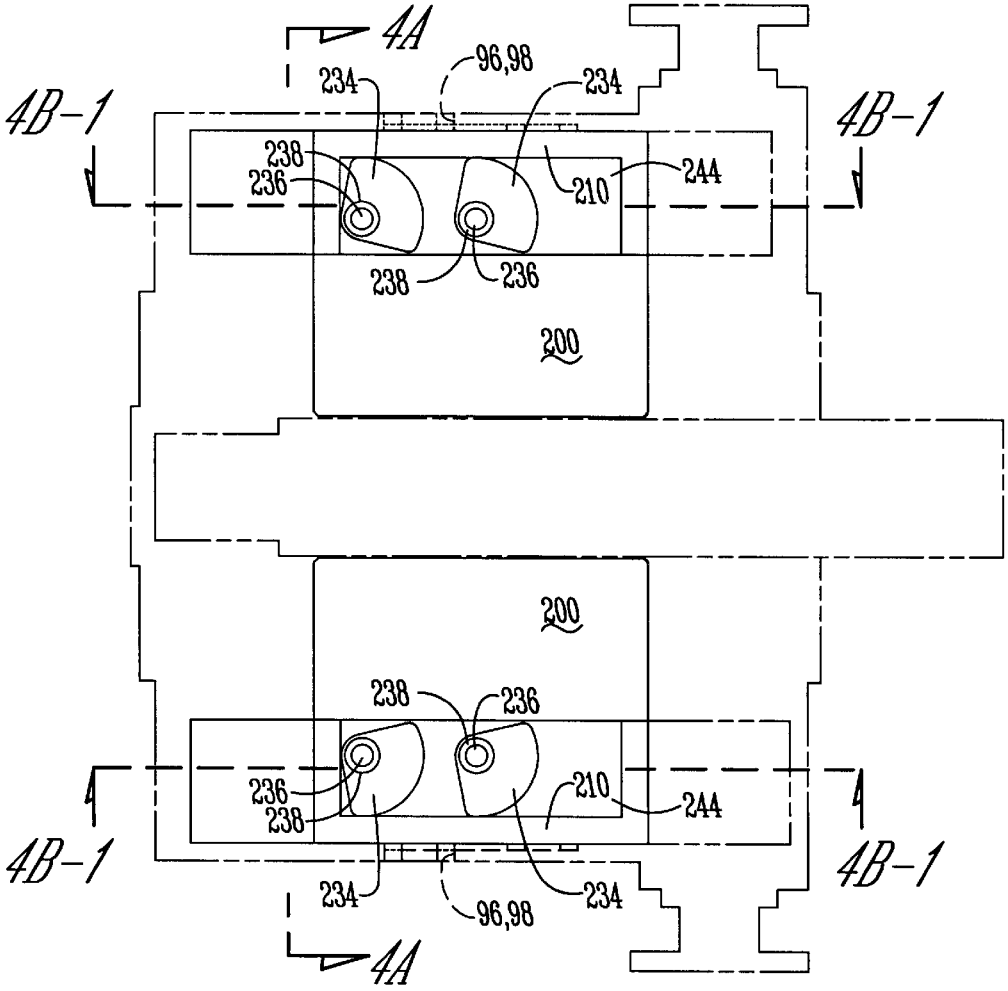
FIG. 4B is a sectional elevation of an axial-vane rotary device of the present invention taken on line 4B—4B of FIG. 4A.

FIG. 4B is a sectional elevation showing the vanes 244 and a plurality of pairs of rockers 234 mounted on axles 236 with bearings 238 and secured by stainless steel snap rings 240, all moved to the extreme left-hand position. The plurality of pairs of rockers permits the centrifugal force load on each rocker to be reduced substantially. The centerline of the rocker group coincides with the vertical centerline of the vane assembly. In this design, due to the additional length of the vane assembly 244, two guide cams 96 and followers 98 are provided to reduce the forces on these components. The centerline of the rocker group and the vertical centerline of the vane assembly 244 are aligned with the centerline between the pair of guide cams 96 and followers 98. In addition to providing additional centrifugal force restraint, the plurality of rocker pairs 234 prevent the vane from rotating about its transverse centerline.

Figure 4C:
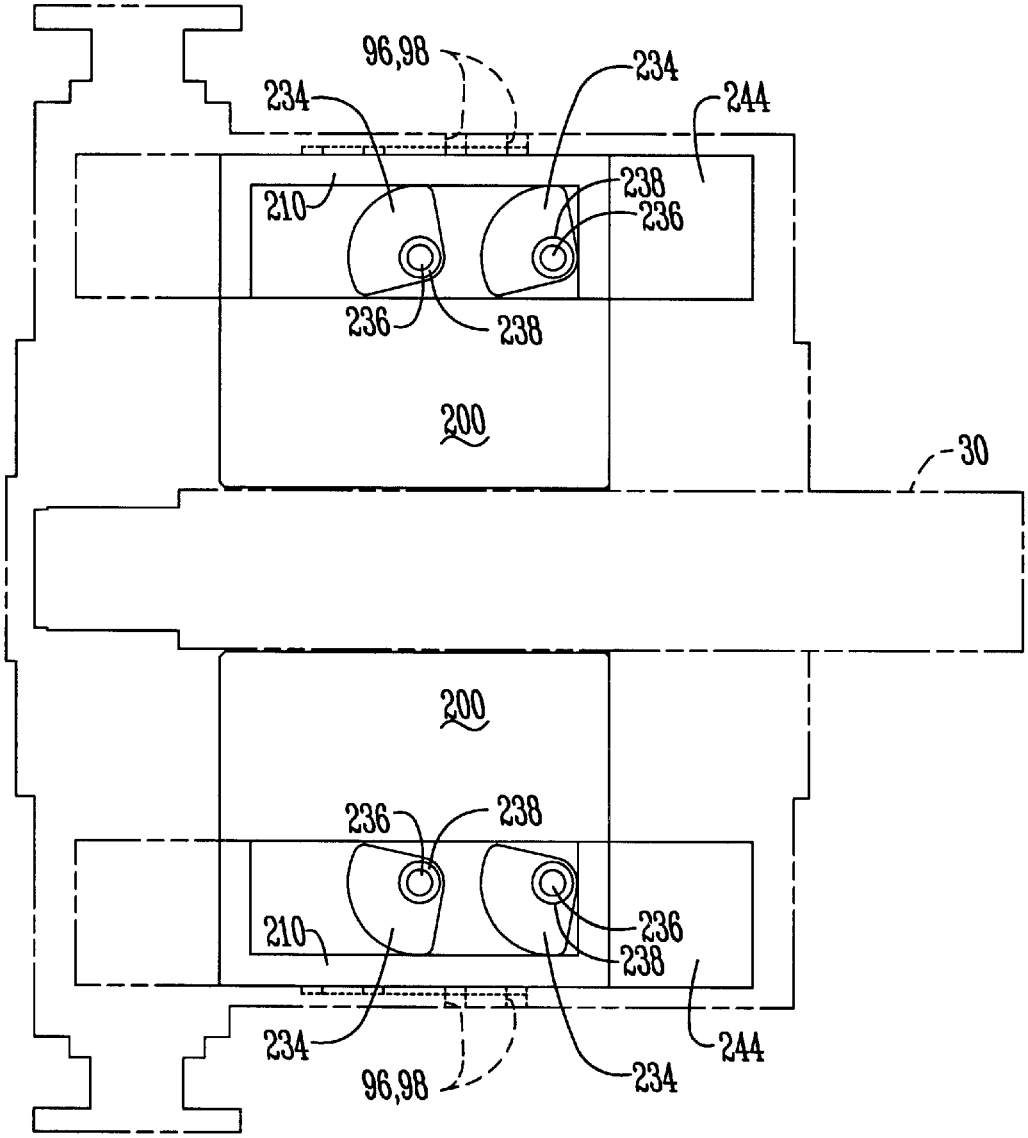
FIG. 4C is a sectional view taken at 90 degrees with respect to FIG. 4B.

FIG. 4C is a sectional view taken at 90 degrees from the view shown in FIG. 4B, and shows the vane assemblies 244 moved to their extreme right-hand position. Rocker groups 234 have also moved to the extreme right-hand position in the cavities on each side of the segmental individual rotor end blocks 232, and the centerline of the rocker groups 236 again coincides with the centerline of the multiple guide cams 96 and followers 98.

Figure 4D:
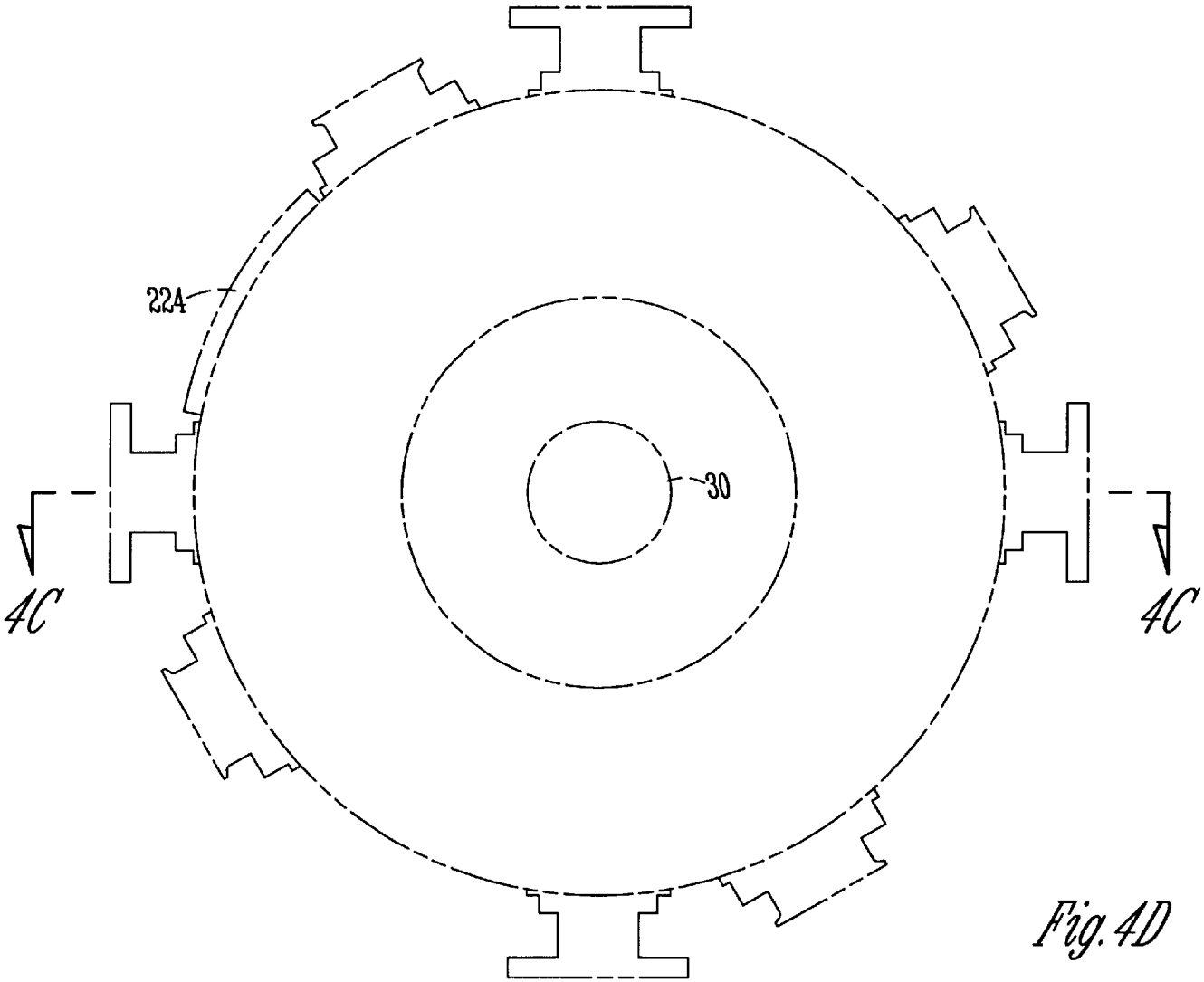
FIG. 4D is an elevational view of an axial-vane rotary device showing the end of the drive shaft.

FIG. 4D is an elevation view of the drive end of the present invention of an axial-vane rotary device.

It will be appreciated that the interfacing surfaces of the restraining ledges 210 and rockers 234 may be equipped with registering means such as gear teeth or pins, etc., to prevent the rockers from slipping out of proper position with respect to their positions in the end cavities of the segmental individual rotor end blocks due to loss of contact with the restraining ledges for any reason. Rockers becoming disoriented with respect to their proper position in the end cavities could result in the ends of these cavities becoming damaged by the uncontrolled rotation.

It will also be appreciated that the restraining ledges 210 formed by the end cavities in the segmental individual rotor end blocks 202, 204, or 232 could alternatively be provided as transverse projections on the side portions of these segmental individual rotor end blocks without departing from the spirit of the invention.

It is to be noted that all of the alternative vane restraint mechanisms shown use a common retaining means, i.e., the transversely oriented retainer ledge 210. The slidable bearing blocks, rollers and rockers are provided to meet the requirements of various applications.

Also, in all of the vane restraint mechanisms shown, it will be appreciated that all are in compression and none are in tension, to avoid circumstances of material fatigue and subsequent failure in severe service applications and high speed operation. In all cases, it will be understood that mechanical equivalents of the components or configurations shown or described may be utilized without departing from the spirit of the invention.

It will be understood that guide cams 96 and followers 98 are prior art and not controlling upon this invention. Alternate vane actuation mechanisms may be used without departing from the spirit of this invention, in all cases.

It will be further understood, that where rollers or rockers are employed, the bearings, if any, may be located in the vane blades, or the rollers or rockers, or both, to suit the individual applicaton, without departing from the spirit of the invention.

From the foregoing it can be seen that a means for providing restraint to laterally slidable vanes against centrifugal forces generated by a rotating rotor in an axial-vane rotary device has been accomplished by the present invention, and that it accomplishes at least all of the stated objectives.

What is claimed is:

1. An axial-vane rotary device comprising:

a vane assembly including a vane blade member with pivotally mounted rockers thereon that serves as a vane restraint mechanism to counteract centrifugal forces.

2. The device of claim 1 wherein the rockers are wedge-shaped wheel segments.

3. The device of claim 1 wherein the rockers have a rolling interface surface equal in length to the stroke dimension of the axial-vane rotary device.

4. The device of claim 1 wherein the rockers are oriented to roll along a retainer ledge of the vane assembly to prevent them from becoming disoriented relative to their position in a recess of the vane assembly.

5. An axial-vane rotary device, comprising:

a vane assembly including a vane blade member with a plurality of pivotally mounted rockers, the rockers being wedge-shaped wheel segments with a rolling interface surface equal in length to the stroke dimension of the axial-vane rotary device, and an outer recess surface with registering means to control the interaction of the rocker with a restraining ledge of the vane blade member to prevent the rocker rotation from becoming disoriented.

6. An axial-vane rotary device comprising:

a vane assembly including a vane blade member with pivotally mounted rockers thereon that serves as a vane restraint mechanism to counteract centrifugal forces, a T-shaped cross section on the vane assembly with projection portions that form retainer ledges, the rockers having wedge-shaped wheel segments with a rolling interface equal in length to the stroke dimension of the axial vane rotary device, the rockers being oriented to roll along the retainer ledges of the vane assembly.

7. The device of claim 6 wherein the rolling interface surface of each rocker and a vane assembly retainer ledge are equipped with registering means to control the interaction of the rocker with the vane assembly restraining ledge to prevent the rocker rotation from becoming disoriented with respect to the rockers position in the recess.

8. An axial-vane rotary device, comprising, a rotor housing having an aperture and having one end opening sufficient to permit the installation or removal of one or more segmental individually removable end blocks without further disassembly of the axial-vane rotary device, the aperture being closable with a closure plate, and seal means on the closure plate to prevent leakage of liquids or gases from the axial-vane rotary device.

9. An axial-vane rotary device, comprising:

a rotor assembly comprised of a rotor core, a plurality of segmental individually removable rotor end blocks removably attached to the rotor core, the rotor end blocks having recesses in each end to encapsulate a vane restraint mechanism, and one or more end blocks having a removable endwall which can be removed for access to the vane restraint mechanism without disturbing the installation of the segmental individual rotor end blocks.

10. The device of claim 9 wherein components of the vane restraint mechanism are slidably mounted on the ledges.

11. The device of claim 9 wherein components of the vane restraint mechanism are rotatably mounted on the ledges.

12. The device of claim 9 wherein the vane restraint mechanism comprises a vane assembly including a vane blade member with slide blocks mounted thereon slidably mounted along the outer surfaces of the recesses in the rotor end blocks to counteract centrifugal forces.

13. The device of claim 9 wherein the vane restraint mechanism comprises a vane assembly including a vane blade member having a plurality of rotatably attached rollers, the rollers being arranged in such a manner as to roll along the outer surfaces of the recesses in the rotor end blocks to counteract centrifugal force.

14. The device of claim 9 wherein the vane restraint mechanism comprises a vane assembly including a vane blade member having a plurality of rockers, the rockers being defined as wedge-shaped wheel segments with a rolling interface surface equal to the stroke dimension of the axial-vane rotary device, the rockers being pivotally mounted on the vane blade and being oriented to roll along the outer surfaces of the recesses in the rotor end blocks to counteract centrifugal force.

15. The device of claim 9 wherein outer surfaces of the recesses form ledges upon which components of a vane restraint mechanism are movably mounted.

16. The device of claim 15 wherein rotor end blocks have end portions parallel to and adjacent to transverse slidable vane assemblies, the side portions being equipped with integral bearing blocks which can slide along the retainer ledges of the laterally slidable vanes to serve as vane restraint mechanisms to counteract centrifugal force.

17. The device of claim 15 wherein rotor end blocks have end portions parallel to and adjacent to transverse slidable vane assemblies, the side portions being equipped with integral bearing blocks which can slide along the retainer ledges of the laterally slidable vanes to serve as vane restraint mechanisms to counteract centrifugal force.

* * * * *